US010982434B2

(12) United States Patent
Lee et al.

(10) Patent No.: US 10,982,434 B2
(45) Date of Patent: Apr. 20, 2021

(54) STUD CONNECTION STRUCTURE FOR NOISE REDUCING WALL

(71) Applicants: DOOSAN HEAVY INDUSTRIES & CONSTRUCTION CO., LTD., Changwon-si (KR); GENERAL ELECTRIC COMPANY CO., LTD

(72) Inventors: Sang Hyuk Lee, Yongin-si (KR); Sang Soon Lee, Changwon-si (KR); Jang Pil Lee, Gyeongsangnam-do (KR); Jong Kuk Lee, Changwon-si (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 0 days.

(21) Appl. No.: 16/586,878

(22) Filed: Sep. 27, 2019

(65) Prior Publication Data

US 2021/0071414 A1 Mar. 11, 2021

(30) Foreign Application Priority Data

Sep. 9, 2019 (KR) ..... 10-2019-0111277

(51) Int. Cl.

| | |
|---|---|
| ***E04B 1/90*** | (2006.01) |
| ***E04C 2/02*** | (2006.01) |
| ***F24F 13/24*** | (2006.01) |
| ***E04B 2/00*** | (2006.01) |

(52) U.S. Cl.

CPC ..... *E04B 1/90* (2013.01); *E04C 2/02* (2013.01); *E04C 2/46* (2013.01); *F24F 13/24* (2013.01); *F24F 2013/242* (2013.01)

(58) Field of Classification Search

CPC ..... E04B 1/90; F24F 13/24; F24F 2013/242; E04C 2/02; E04C 2/46

USPC ..... 411/87, 378, 379, 383

See application file for complete search history.

(56) References Cited

U.S. PATENT DOCUMENTS 1,136,234 A * 4/1915 Johnson et al. ..... F16B 39/10 411/91
2,879,660 A * 3/1959 Reintjes ..... F23M 5/04 52/509
2,927,496 A * 3/1960 Goodman ..... F16B 5/0225 411/383

(Continued)

FOREIGN PATENT DOCUMENTS

JP 2016-212263 A 12/2016
KR 2006-0031879 A 4/2006

(Continued)

*Primary Examiner* — Joshua K Ihezie

(74) *Attorney, Agent, or Firm* — INVENSTONE Patent, LLC

(57) ABSTRACT

A noise reducing wall system is provided. The noise reducing wall system includes first and second board layers facing in parallel with each other along a longitudinal direction thereof, a heat insulation member surrounded by the first and second board layers, and a stud connection structure that fastens the first and second board layers using a stud bolt passing through the heat insulation member to connect the first board layer and the second board layer. The stud bolt connects the first and second board layers in a thickness direction and has a bent portion extending in the longitudinal direction and disposed at an intermediate point in the thickness direction.

2 Claims, 9 Drawing Sheets

(56) References Cited

U.S. PATENT DOCUMENTS 3,331,525 A * 7/1967 Coehn ..... F17C 3/025 220/560.07
3,670,917 A * 6/1972 Nishimaki ..... F17C 13/004 220/560.15
3,907,151 A * 9/1975 Gilden ..... F16J 12/00 220/721
3,975,879 A * 8/1976 Birch ..... F16L 59/02 376/290
4,061,162 A * 12/1977 Jones ..... F16L 58/08 138/147
4,157,001 A * 6/1979 Pickles ..... F27D 1/144 110/336
4,802,902 A * 2/1989 Bauerle ..... F02M 35/02 123/579
5,110,006 A * 5/1992 Becker ..... F16L 59/029 220/592.26
5,437,312 A * 8/1995 Gumangan ..... F16L 59/12 138/147
5,513,545 A * 5/1996 George ..... B25B 23/103 81/177.1
6,755,218 B2 * 6/2004 Whitty ..... F16L 59/123 138/147
7,475,518 B2 * 1/2009 Suehiro ..... F16B 5/02 52/295
7,549,507 B2 * 6/2009 Aida ..... F23J 13/02 181/224
7,637,071 B2 * 12/2009 Pryor ..... E04G 23/0218 52/295
8,459,407 B2 6/2013 Jangili
10,072,527 B2 * 9/2018 Bracquemart ..... F16L 59/12
2006/0272282 A1 * 12/2006 Aida ..... F23J 13/02 52/796.1
2010/0045124 A1 * 2/2010 Kakimoto ..... H02K 5/24 310/51
2010/0162524 A1 * 7/2010 Lin ..... B25G 3/30 16/110.1
2013/0164096 A1 * 6/2013 Dutler ..... F16B 25/0031 411/366.1
2016/0003193 A1 * 1/2016 Matsuyama ..... F02K 1/822 138/149
2017/0096966 A1 4/2017 Joshi et al.

FOREIGN PATENT DOCUMENTS

KR 2014-0136826 A 12/2014
KR 10-1817474 B1 1/2018

* cited by examiner

STUD CONNECTION STRUCTURE FOR NOISE REDUCING WALL

CROSS REFERENCE TO RELATED APPLICATION

The present application claims priority to Korean Patent Application No. 10-2019-0111277, filed on Sep. 9, 2019, the entire disclosure of which is incorporated herein by reference in its entirety.

BACKGROUND

1. Field

Apparatuses and methods consistent with exemplary embodiments relate to a noise reducing wall system and, more particularly, to a noise reducing wall system having improved sound insulation performance by using a newly designed stud connection structure that mechanically fastens inner and outer board layers surrounding a heat insulation member.

2. Description of the Related Art

Many air-conditioning apparatuses or industrial facilities installed in large buildings generate loud noise during operation thereof. For example, in facilities where high temperature and high-pressure fluids flow at high speeds, such as an exhaust duct of a gas turbine used for power generation and a heat recovery steam generator (HRSG) which is an industrial boiler connected to the rear end of a gas turbine, strong noise occurs due to vibration of fluids. For example, gas turbines produce sound of a level of PWL 150 dB(A).

Noise from industrial and large commercial premises is a kind of environmental pollution to be controlled according to regulations. Therefore, measures for noise reduction are required.

FIGS. 1 and 2 are diagrams respectively illustrating a plan view and a cross-sectional view of a noise reducing wall wrapping an exhaust duct or a heat recovery steam generator (HRSG) to insulate or absorb noise. A typical noise reducing wall system may include a first board layer and a second board layer facing each other along a longitudinal direction, a heat insulation member disposed in a space between the first and second board layers, and a stud connection structure securely fastening the two board layers using a stud bolt extending in a thickness direction.

The first board layer (e.g., an inner wall) is a duct plate that forms the exterior of a duct structure to reduce noise, and the second board layer (e.g., an outer wall) is a liner plate. A heat insulation material having a heat keeping function and a heat insulating function is surrounded by the first board layer and the second board layer, and stud bolts are densely installed at intervals of about 30 cm to form a noise reducing wall system.

There are two common ways to improve the sound insulation performance of a noise reducing wall. One is a method of increasing the gap size between the first and second board layers to increase the volume of the heat insulation material disposed in the space between the first board layer and the second board layer. The other one is a method of increasing the thicknesses of the first and second board layers to increase resistance to noise and vibration.

However, these methods are not cost effective and have a limit in improving sound insulation performance. That is, the sound insulation performance cannot be improved to the extent that is beyond a predetermined level with the two methods. That is, an improvement in sound insulation performance is limited. Therefore, it is difficult to achieve the desired level of sound reduction with these methods. To solve this problem, there have been attempts to use a double noise reducing wall system. However, all existing noise reducing methods including the double noise reducing wall system require a huge design change in an existing wall system and significantly increase cost for noise reducing.

SUMMARY

Aspects of one or more exemplary embodiments provide a new noise reducing wall system capable of improving sound insulation performance while minimizing design changes to existing noise reducing wall systems.

Additional aspects will be set forth in part in the description which follows and, in part, will become apparent from the description, or may be learned by practice of the exemplary embodiments.

According to an aspect of an exemplary embodiment, there is provided a noise reducing wall system including: first and second board layers facing each other along a longitudinal direction thereof; a heat insulation member surrounded by the first and second board layers; and a stud connection structure including a stud bolt that passes through the heat insulation member in a thickness direction to connect the first and second board layers, in which the stud bolt has a bent portion in a midpoint in the thickness direction.

The stud bolt may include a first linear portion extending in the thickness direction perpendicularly from the first board layer and a second linear portion extending in the thickness direction perpendicularly from the second board layer, and the bent portion perpendicularly connected to the first linear portion and the second linear portion.

The bent portion may include a first bent portion connecting the first linear portion and the second linear portion.

The bent portion may include a first bent portion connected to and bent from the first linear portion, a second bent portion connected to and bent from the second linear portion, and a transition portion extending in the thickness direction so as to connect the first linear portion and the second linear portion.

The first and second linear portions may be collinear.

The stud bolt may include a first linear portion extending in the thickness direction perpendicularly from the first board layer and two second linear portions including a first second linear portion and a second second linear portion and extending in the thickness direction perpendicularly from the second board layer, and the bent portion perpendicularly connected to each of the first second linear portion and the second second linear portion.

The first linear portion may extend in the thickness direction and be disposed at an intermediate position between the first second linear portion and the second second linear portion in the longitudinal direction.

The stud bolt may further include a second bent portion arranged between the first second linear portion and the second second linear portion in the longitudinal direction to intersect the bent portion, and two third second linear portions that perpendicularly extend to the second board layer from respective ends of the second bent portion.

The two bent portions orthogonally intersect each other at a midpoint thereof.

The stud bolt is fixed to the first board layer through welding and to the second board layer by a double nut.

According to an aspect of another exemplary embodiment, there is provided a noise reducing wall system including: first and second board layers facing each other along a longitudinal direction thereof; a heat insulation member surrounded by the first and second board layers; and a stud connection structure including a first stud bolt connected to the first board layer, a second stud bolt connected to the second board layer, and a plate extending in a longitudinal direction and connected to a free end of each of the first and second stud bolts, in which the first stud bolt and the second stud bolt are not collinear in a thickness direction.

The first stud bolt may extend to be perpendicular to the first board layer, the second stud bolt may extend to be perpendicular to the second board layer, and the plate may be perpendicularly connected to the free ends of the first and second stud bolts.

The plate may be fixed to either one of the first and second stud bolts through welding and to the other by a double nut.

The first stud bolt is fixed to the first board layer through welding and to the plate by the double nut, and the second stud bolt is fixed to the second board layer by the double nut and to the plate through welding.

The stud connection structure may include multiple connection structure groups, each including the first stud bolt and the second stud bolt, for each of the plates.

The connection structure groups, each including the first stud bolt and the second stud bolt, may be arranged to be equally spaced from each other with respect to the plate.

The noise reducing wall system according to an exemplary embodiment exhibits improved sound insulation performance in comparison with a conventional noise reducing wall system due to the bending of the stud bolt.

The noise reducing wall system according to an exemplary embodiment differs only in the stud bolt connection structure from a conventional noise reducing wall system. Therefore, when using the exemplary embodiments to improve the sound insulation performance, it is not necessary to change any of the overall thickness of the noise reducing wall, the thicknesses of the first and second board layers, the volume (thickness) of the heat insulation member, and the number and positions of the stud bolts. Therefore, it is possible to easily improve sound insulation performance of a wall with the use of the exemplary embodiments. Because there are few design changes in terms of the appearance of a noise reducing wall system in comparison with conventional ones, it is easy to replace conventional walls with the noise reducing wall system according to the exemplary embodiments. In addition, in implementing the exemplary embodiments, because cost increase attributes only to manufacturing of newly designed stud bolts and labor work required to install the new stud bolts, the noise reducing wall system according to the exemplary embodiments has a competitive advantage in cost effectiveness over conventional noise reducing wall systems.

In addition, the noise reducing wall system according to the exemplary embodiments exhibits improved sound insulation performance for almost all frequency ranges compared to conventional noise reducing wall systems. Further, the exemplary embodiment provides various forms of noise reducing wall systems that are effective for sound insulation of different frequency ranges. Therefore, a user can choose a suitable form of noise reducing wall system from among the various forms depending on a given frequency range to be attenuated. That is, the exemplary embodiment enables users to have a wide range of freedom in design.

BRIEF DESCRIPTION OF THE DRAWINGS

The above and other aspects will be more apparent from the following description of the exemplary embodiments with reference to the accompanying drawings, in which.

DETAILED DESCRIPTION

Figure 1:
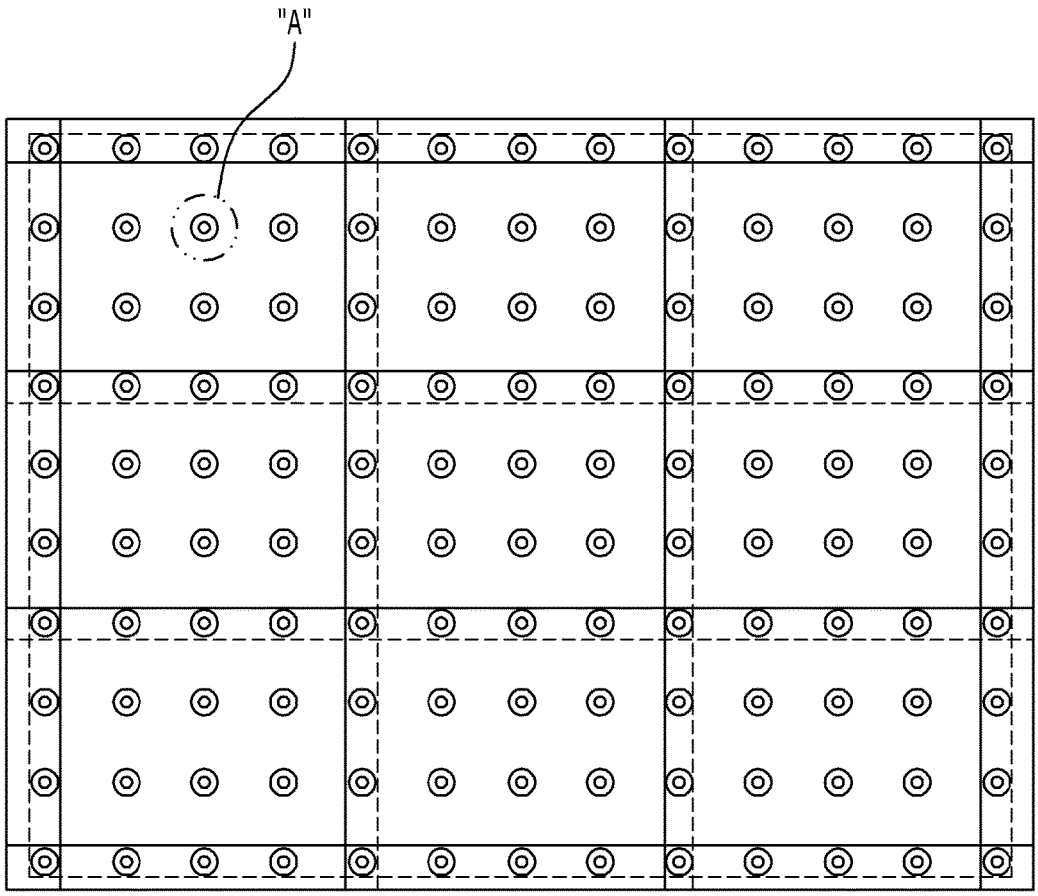
FIG. 1 is a plan view of a conventional noise reducing wall system.

Various modifications may be made to the embodiments of the disclosure, and there may be various types of embodiments Thus, specific embodiments will be illustrated in drawings, and the embodiments will be described in detail in the description. However, it should be noted that the various embodiments are not for limiting the scope of the disclosure to a specific embodiment, but they should be interpreted to include all modifications, equivalents or alternatives of the embodiments included in the ideas and the technical scopes disclosed herein. Meanwhile, in case it is determined that in describing the embodiments, detailed explanation of related known technologies may unnecessarily confuse the gist of the disclosure, the detailed explanation will be omitted.

The terminology used herein is for the purpose of describing particular embodiments only and is not intended to limit the scope of the disclosure. As used herein, the singular forms "a", "an", and "the" are intended to include the plural forms as well unless the context clearly indicates otherwise. In this specification, terms such as "comprises", "includes", or "have/has" should be construed as designating that there are such features, regions, integers, steps, operations, elements, components, and/or a combination thereof in the specification, not to exclude the presence or possibility of adding one or more of other features, regions, integers, steps, operations, elements, components and/or combinations thereof.

Further, terms such as "first," "second," and so on may be used to describe a variety of elements, but the elements should not be limited by these terms. The terms are used simply to distinguish one element from other elements. The use of such ordinal numbers should not be construed as limiting the meaning of the term. For example, the components associated with such an ordinal number should not be limited in the order of use, placement order, or the like. If necessary, each ordinal number may be used interchangeably.

Hereinbelow, exemplary embodiments will be described in detail with reference to the accompanying drawings. In order to clearly illustrate the disclosure in the drawings, some of the elements that are not essential to the complete understanding of the disclosure may be omitted, and like reference numerals refer to like elements throughout the specification.

Figure 3:
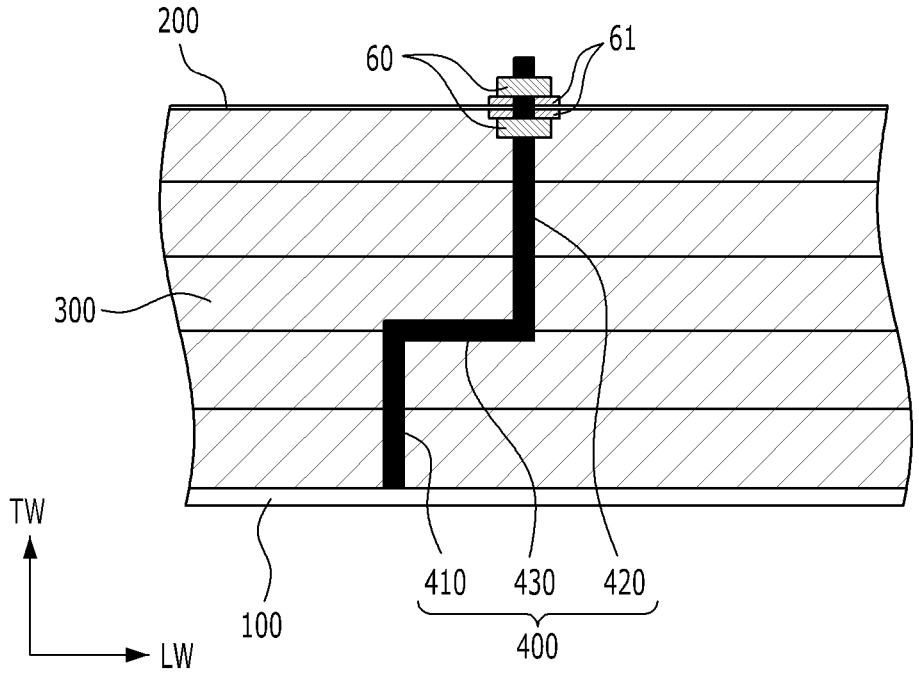
FIG. 3 is a cross-sectional view of a noise reducing wall system according to a first form of a first exemplary embodiment.

FIG. 3 is a cross-sectional view of a noise reducing wall system according to a first form of a first exemplary embodiment. FIG. 3 illustrates basic components of a noise reducing wall system according to an exemplary embodiment.

Figure 2:
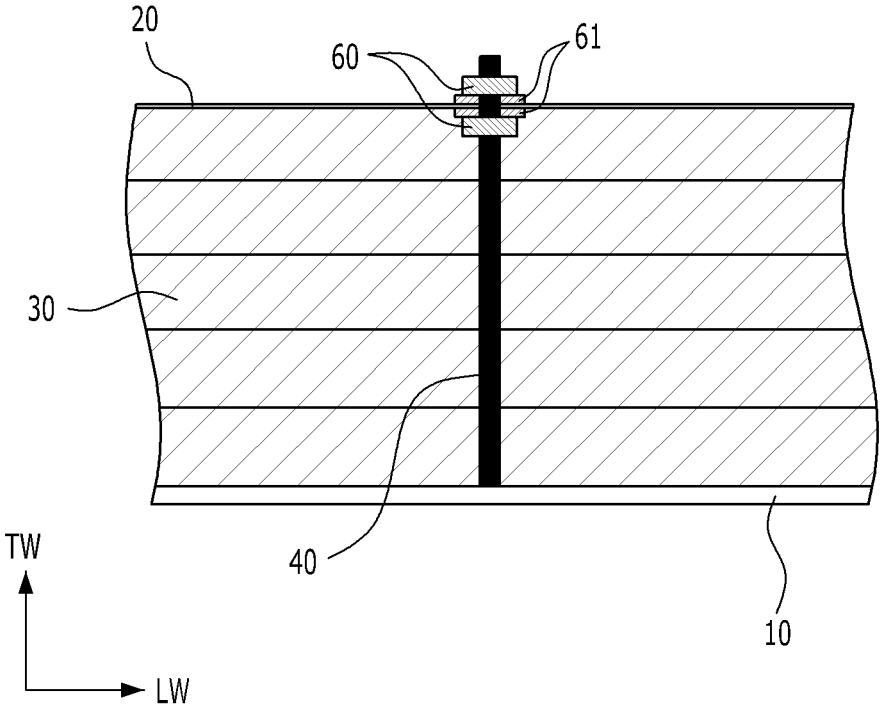
FIG. 2 is a cross-sectional view of a portion "A" of the conventional noise reducing wall system of FIG. 1.

Referring to the cross-sectional view of FIG. 3, the noise reducing wall system includes a first board layer 100 and a second board layer 200 parallelly facing each other along a longitudinal direction LW thereof, a heat insulation member 300 interposed in a space between the first board layer 100 and the second board layer 200, and a stud connection structure including a stud bolt 400 fastening the first board layer 100 and the second board layer 200 by mechanically connecting the first and second board layers 100 and 200 in a thickness direction TW. The basic construction of the noise reducing wall system according to the exemplary embodiment has much in common with a conventional one illustrated in FIG. 2 but differs in terms of the stud connection structure.

Specifically, the stud connection structure included in the noise reducing wall system of the exemplary embodiment features that the stud bolt 400 connects the first board layer 100 and the second board layer 200 by passing through the wall system in the thickness direction TW and is bent at a middle portion thereof. That is, the stud bolt 400 has a bent portion 430 at an intermediate position in the thickness direction TW.

Improvement in sound insulation performance of the noise reducing wall system according to the exemplary embodiment will be described in detail below. The exemplary embodiment is made on the basis of a finding that the stud bolt 400 serves as a main pathway of noise from the first board layer 100 to the second board layer 200. That is, the exemplary embodiment is technologically meaningful in terms of providing a new design of a stud connection structure capable of improving sound insulation performance.

A research on noise propagation mechanisms shows that a large part of noise is propagated to a second board layer (i.e., outer wall) 200 from a first board layer (i.e., inner wall) 100 through stud bolts 400 installed to reinforce a noise reducing wall system. In other words, transference of noise to the outside of the second board layer 200 from the inside of the first board layer 100 through the stud bolts 400 is determined as a major noise leaking factor. Noise and vibration are propagated directly through the stud connection structure (i.e., the first board layer 100——> the stud bolt 400——> the second board layer 200), which are rigid bodies compared to the heat insulation member. For this reason, even though there is the heat insulation member 300 within the noise reducing wall system, noise and vibration cannot be sufficiently absorbed by the heat insulation member 300 surrounding the stud bolts 400.

The exemplary embodiment is based on this noise propagation mechanism described above. Thus, the newly designed stud bolt 400 has a bent portion 430 extending in the longitudinal direction LW and positioned at an intermediate point in the thickness direction TW. Due to the bent portion 430 of the stud bolt 400, a minute degree of elastic deformation in the thickness direction TW is allowed. The self-elastic deformation of the stud bolts 400 in the thickness direction TW lowers sound transmission between the first board layer 100 and the second board layer 200 through the stud bolts 400 and increases friction between the stud bolts 400 and the heat insulation member 300. However, the bent portion 430 may have a disadvantage of weakening the structural rigidity of the stud bolt 400 in the longitudinal direction LW. To compensate for this disadvantage, the stud bolt 400 used in the exemplary embodiment needs to have a larger diameter than conventional stud bolts.

As described above, the noise reducing wall system according to the exemplary embodiment differs only in the design of the stud bolt 400 from conventional sound proofing wall systems. Therefore, it is not necessary to change the overall thickness of an existing noise reducing wall, the thicknesses of first and second board layers 100 and 200, the volume (or thickness) of the heating insulation member 300, or the number and installation positions of stud bolts 400 when applying the exemplary embodiment to an existing wall system to improve sound insulation performance. Because there are few design differences in the external form between an existing noise reducing wall system and the noise reducing wall system of the exemplary embodiment, it is easy to replace the existing noise reducing wall system with the noise reducing wall system according to the exemplary embodiment. In addition, because cost increasing factors in improving sound insulation performance are limited to manufacturing of newly designed stud bolts 400 and labor work to install the new stud bolts, the exemplary embodiment has a competitive advantage in cost effectiveness over conventional ones in improving sound insulation performance.

In the noise reducing wall system according to the first form of the first exemplary embodiment illustrated in FIG. 3, the stud bolt 400 includes a first linear portion 410 extending in the thickness direction TW to be perpendicular to the first board layer 100, a second linear portion 420 extending in the thickness direction TW to be perpendicular to the second board layer 200, and the bent portion 430 that is perpendicularly connected to the first linear portion 410 and the second linear portion 420. The first linear portion 410 and the second linear portion 420 are designed taking into account the structural rigidity in the direction of contraction of the stud bolt 400 (i.e., the thickness direction TW of the noise reducing wall). The bent portion 430 may be oblique or perpendicular to the first and second linear portions 410 and 420. However, it is desirable that the bent portion 430 is perpendicular to each of the first and second linear portions 410 and 420 in terms of the structural rigidity in the direction of contraction.

In FIG. 3, the bent portion 430 consists of a single bent portion 430 connecting the first linear portion 410 and the second linear portion 420.

Figure 4:
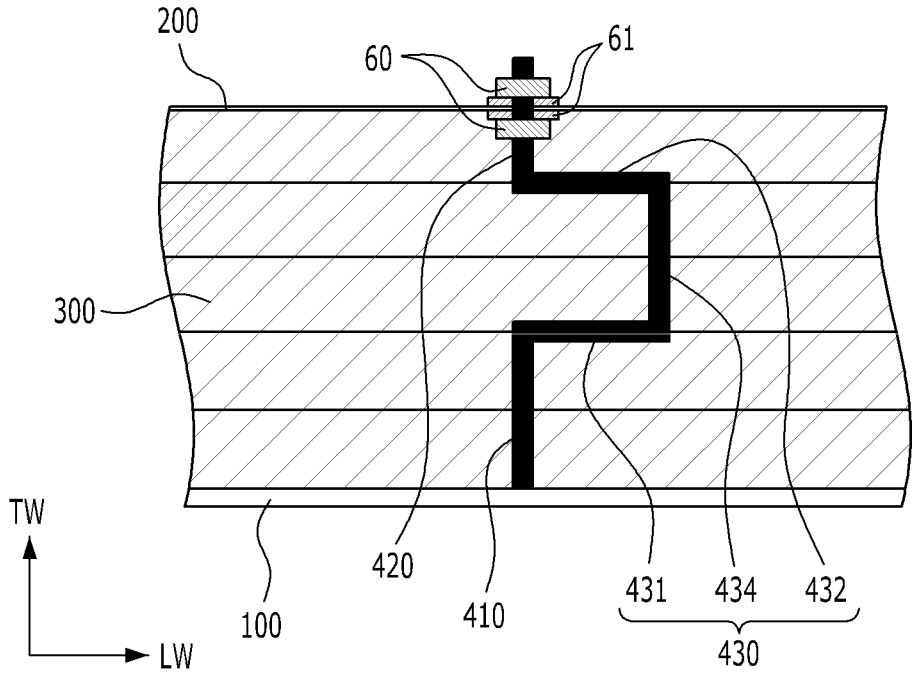
FIG. 4 is a cross-sectional view of a noise reducing wall system according to a second form of the first exemplary embodiment.

Referring to FIG. 4 that illustrates the second form of the first exemplary embodiment, the bent portion 430 includes a first bent portion 431 connected to the first linear portion 410, a second bent portion 432 connected to the second linear portion 420, and a transition portion 434 extending in the thickness direction TW to connect the first bent portion 431 and the second bent portion 432. Thus, the bent portion 430 is overall U-shaped. In all of the forms of the first and second exemplary embodiments, the basic noise reduction mechanisms are same. Therefore, a redundant description will not be given.

In each form of the first exemplary embodiment illustrated in FIGS. 3 and 4, the first linear portion 410 perpendicular to the first board layer 100 and the second linear 420 perpendicular to the second board layer 200 are collinear. This arrangement has advantages of securing the structural rigidity in the direction of contraction of the stud bolt 400 and maintaining the same installation position of the stud bolt as in a conventional technology.

Figure 5:
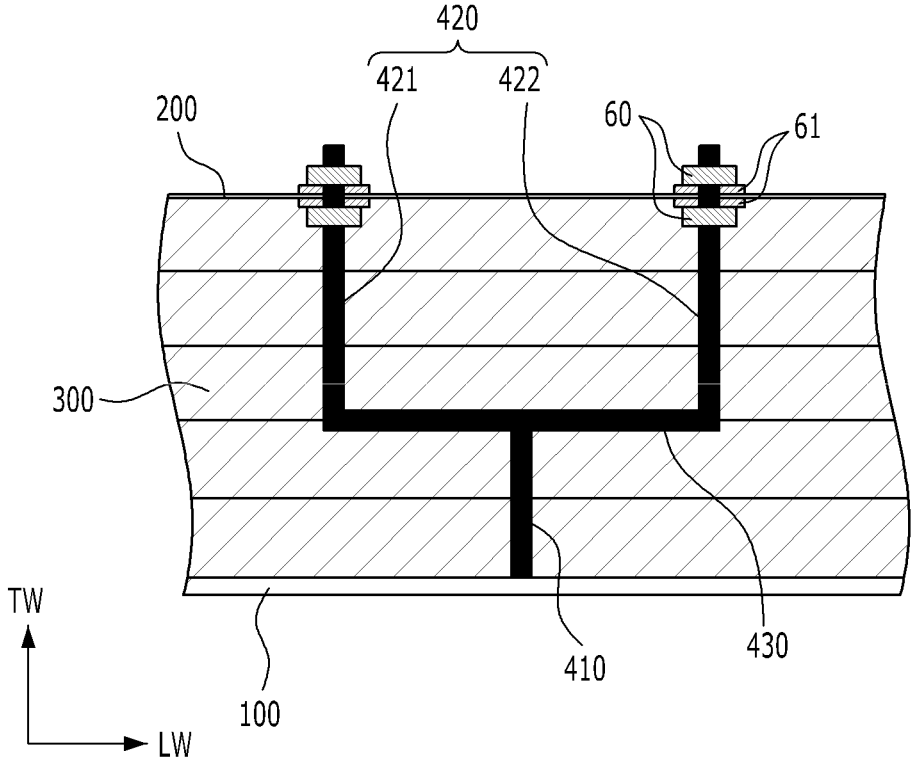
FIG. 5 is a cross-sectional view of a noise reducing wall system according to a third form of the first exemplary embodiment.

FIG. 5 illustrates a noise reducing wall system according to a third form of the first exemplary embodiment. The third form of the first exemplary embodiment differs from the first form of the first exemplary embodiment illustrated in FIG. 3 in the point that the single second linear portion 420 is replaced with two second linear portions (hereinafter, respectively called a first second linear portion 421 and a second second linear portion 422) each of which is perpendicular to the second board layer 200.

Comparing the second form of the first exemplary embodiment, illustrated in FIG. 4, and the third form of the first exemplary embodiment, illustrated in FIG. 5, although both have a structure in which there are two bent portions 430, the two bent portions 430 are connected in series in the thickness direction TW in the second form of the first exemplary embodiment, but there is a difference in that the two bent portions 430 are connected in parallel in the third form of the first exemplary embodiment.

Referring to FIG. 5, the bent portion 430 is perpendicularly connected to the first linear portion 410 extending perpendicularly to the first board layer 100 and to each of the two second linear portions (i.e., the first second linear portion 421 and the second second linear portion 422), each of which extends perpendicularly to the second board layer 200. For the structural balance, the first linear portion 410 is preferably centered between the two second linear portions 421 and 422.

Figure 6:
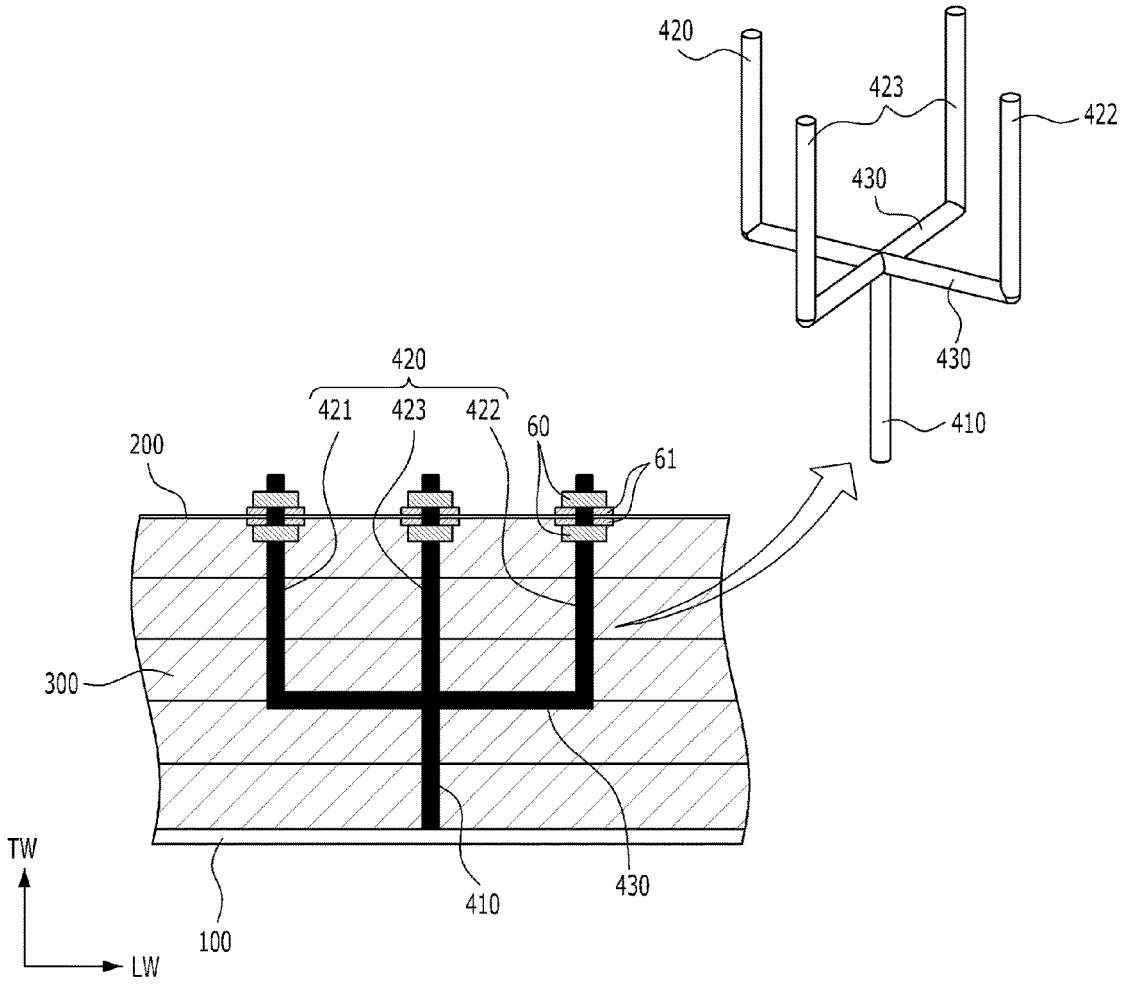
FIG. 6 is a cross-sectional view of a noise reducing wall system according to a fourth form of the first exemplary embodiment.

FIG. 6 illustrates a noise reducing wall system according to a fourth form of the first exemplary embodiment. Referring to FIG. 6, a stud bolt includes two bent portions 430 orthogonally intersecting each other, one first linear portion 410 extending in the thickness direction TW from the first board layer 100 to the intersection of the two bent portions 430, and four second linear portions 421, 422, and 423 extending in the thickness direction TW to the second board layer 200 from the two bent portions 430. The two second linear portions (i.e., first second linear portion and second second linear portion) 421 and 422 are connected to respective ends of one of the two bent portions 430. The other two second linear portions 423 (i.e., third second linear portions) are connected to respective ends of the other bent portion 430. In other words, the fourth form of the first exemplary embodiment further includes another bent portion 430 and two second linear portions 423 as compared with the third form of the first exemplary embodiment illustrated in FIG. 5. The two bent portions 430 are arranged to orthogonally intersect each other, and the first linear portion 410 is connected to the intersection of the two bent portions 430.

In this case, in terms of the structural balance, the two bent portions 430 can intersect orthogonally at the midpoint of each other. Because the number of second linear portions 421, 422, and 423 that can accommodate a minute elastic deformation is increased, it is possible to more effectively reduce sound transmission through the stud bolts 400.

In the first through fourth forms of the first exemplary embodiment described above, the first board layer (i.e., inner wall) 100 is a duct plate that forms an outer surface of a duct structure serving as a noise source, and the second board layer (i.e., outer wall) 200 is a liner plate. The stud bolt 400 may be fixed to the first board layer 100 through welding and to the second board layer 200 with a double nut 60. The double nut 60 means two nuts that are engaged with the stud bolt 400 on the inner surface and the outer surface of the second board layer 200, respectively. Between each of the two nuts and the second board layer 200, washers 61 are provided to accommodate the thermal expansion of the second board layer 200.

Figure 7:
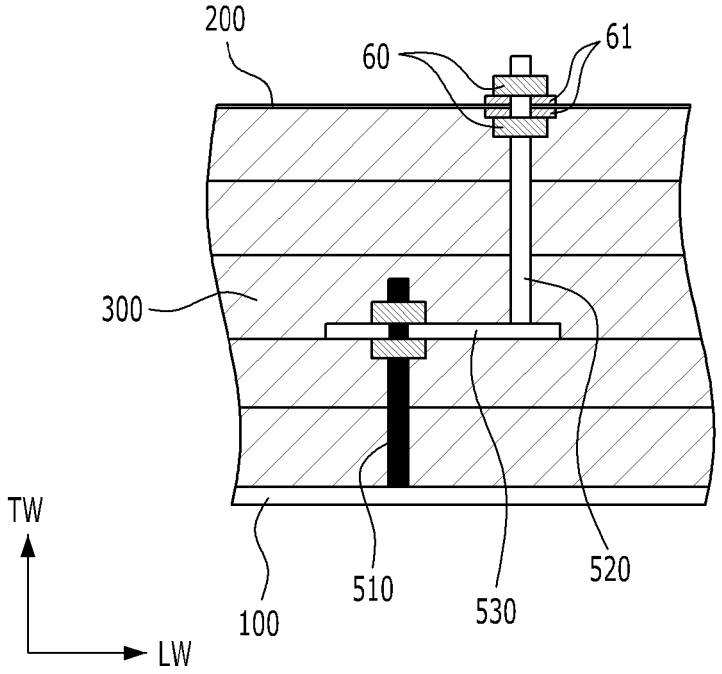
FIG. 7 is a cross-sectional view of a noise reducing wall system according to a first form of a second exemplary embodiment.
Figure 8:
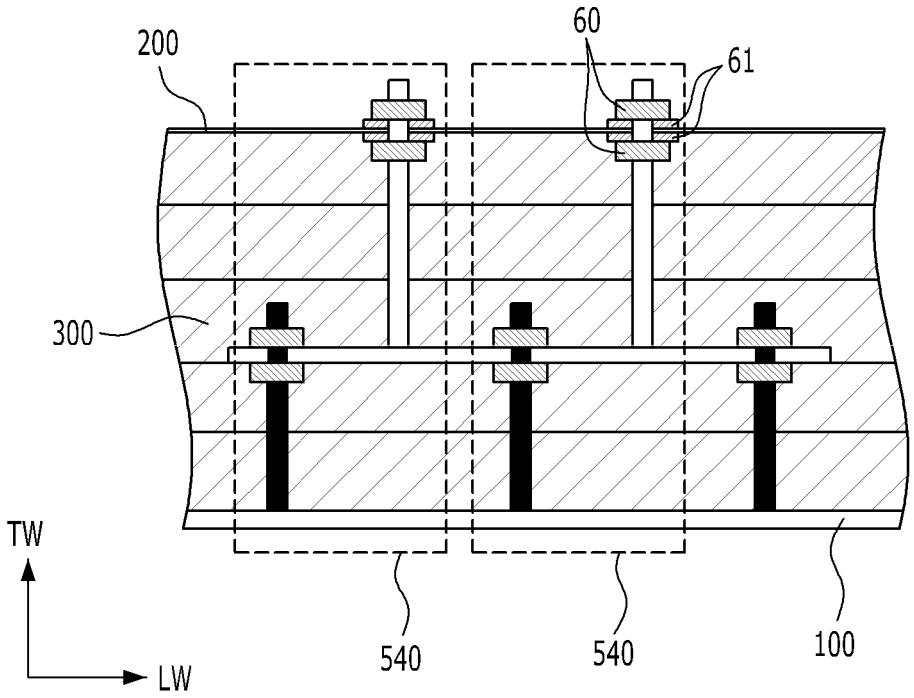
FIG. 8 is a cross-sectional view of a noise reducing wall system according to a second form of the second exemplary embodiment.

FIGS. 7 and 8 respectively illustrate noise reducing wall systems according to a first form and a second form of a second exemplary embodiment. In the second exemplary embodiment, unlike the first exemplary embodiment in which the stud bolt 400 which is a bent stud bolt having a bent portion 430 is used, an existing stud bolt is used as it is. However, the second exemplary embodiment uses a plate 530. Although the plate 530 is used, the basic noise reduction mechanism is the same as a case in which the bent stud bolt is used.

Referring to FIG. 7, a stud connection structure includes a first stud bolt 510 connected to a first board layer 100, a second stud bolt 520 connected to a second board layer 200, and a plate 530 arranged to extend in a longitudinal direction LW and connected to a free end of each of the first and second stud bolts 510 and 520. The first stud bolt 510 and the second stud bolt 520 are not collinear in a thickness direction TW. The plate 530 having a size equal to or greater than a gap size between the first stud bolt 510 and the second stud bolt 520 in terms of the thickness direction TW serves as the bent portion 430 used in the first exemplary embodiment.

The second exemplary embodiment requires a larger number of stud bolts 510 and 520 than the first exemplary embodiment, but is advantageous over the first exemplary embodiment in that existing linear stud bolts can be used as they are without using the bent stud bolts 400 provided in the first exemplary embodiment. In addition, the first exemplary embodiment and the second exemplary embodiment differ in effective frequency range for which sound insulation needs to be improved. This difference will be described with reference to FIG. 9.

Referring to FIG. 7, the first and second stud bolts 510 and 520 are installed to be perpendicular to the first and second board layers 100 and 200, and the plate 530 is perpendicularly connected to the free ends of the first and second stud bolts 510 and 520.

The plate 530 is fixed to either one of the first and second board layers 100 and 200 through welding and to the other one with a double nut 600. For example, the first stud bolt 510 is fixed to the first board layer 100 through welding and to the plate 530 with a double nut 60, and the second stud bolt 520 is fixed to the second board layer 200 with a double nut 60 and to the plate 530 through welding.

Referring to FIG. 8, multiple connection structure groups 540, each including the first stud bolt 510 and the second stud bolt 520, are connected by a single plate 530. In this case, the multiple connection structure groups 540, each including the first and second stud bolts 510 and 520, are evenly spaced from each other.

Figure 9:
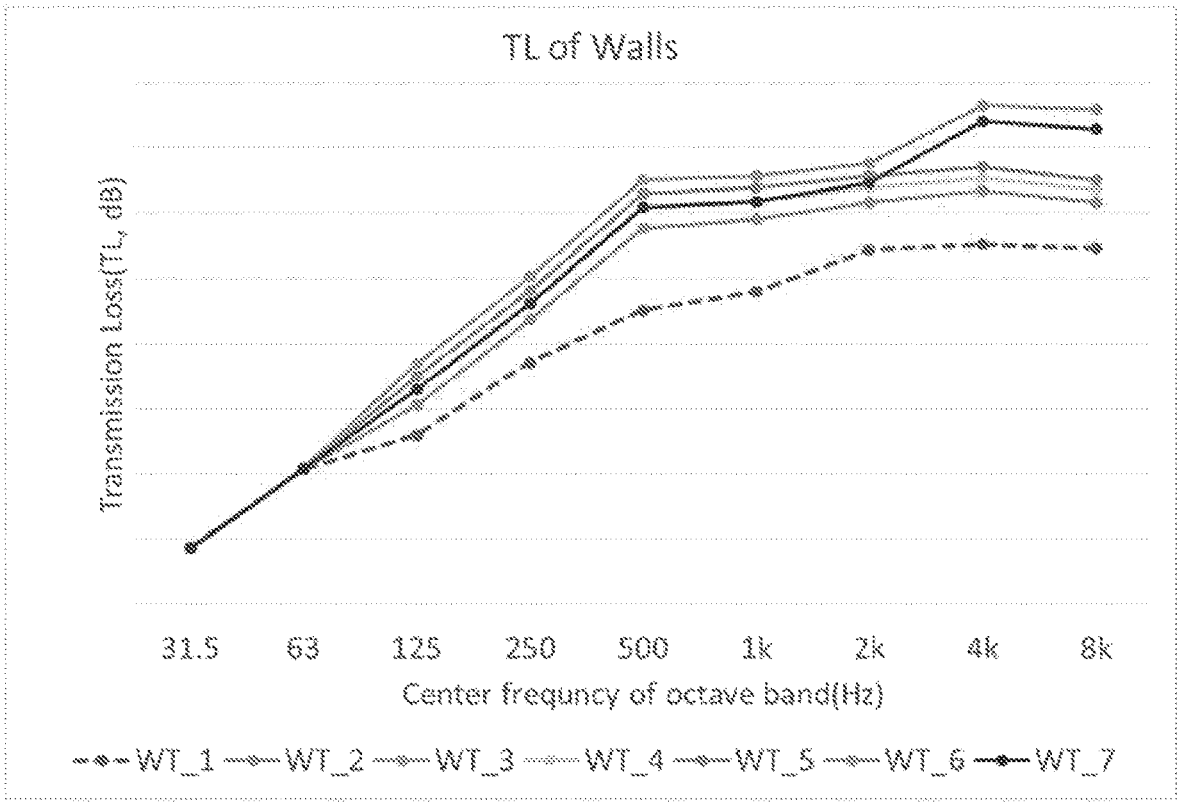
FIG. 9 is a graph showing evaluation results of comparison of sound insulation performance of each of the various forms of the first and second exemplary embodiments.

FIG. 9 shows the results of comparison in sound insulation performance (i.e., absolute value of sound transmission loss represented in a unit of dB) between a conventional stud connection structure WT_1 and each of the stud connection structures WT_2 through WT_7 according to the exemplary embodiments. In FIG. 9, a greater value on the vertical axis means a higher noise reduction performance for noise of a given frequency.

As illustrated in FIG. 9, the stud connection structures according to the exemplary embodiments exhibit better sound insulation performance for all interest frequency ranges than a conventional one. For example, the second exemplary embodiment shows better sound insulation performance than the first exemplary embodiment for a high frequency range of noise. Therefore, when there is an existing noise reducing wall system and a particular frequency range for which sound insulation performance of the existing noise reducing wall system needs to be improved is identified, a suitable one of the various stud connection structures according to the exemplary embodiments may be selected depending on the identified frequency range. That is, one or more exemplary embodiments may provide a wide range of design choices for a stud connection structure.

While exemplary embodiments have been described with reference to the accompanying drawings, it is to be understood by those skilled in the art that various modifications in form and details may be made therein without departing from the sprit and scope as defined by the appended claims. Therefore, the description of the exemplary embodiments should be construed in a descriptive sense and not to limit the scope of the claims, and many alternatives, modifications, and variations will be apparent to those skilled in the art.

What is claimed is:

1. A noise reducing wall system comprising:

first and second board layers facing in parallel each other along a longitudinal direction thereof;

a heat insulation member surrounded by the first and second board layers; and a stud connection structure including a stud bolt passing through the heat insulation member to connect the first board layer and the second board layer, wherein the stud bolt connects the first board layer and the second board layer in a thickness direction of the first and second board layers and has a bent portion extending in the longitudinal direction at an intermediate position in the thickness direction, wherein the stud bolt comprises:

a first linear portion extending perpendicularly to the first board layer;

a second linear portion extending perpendicularly to the second board layer; and the bent portion perpendicularly connected to each of the first linear portion and the second linear portion, wherein the bent portion comprises a first bent portion connected to and bent from the first linear portion, a second bent portion connected to and bent from the second linear portion, and a transition portion extending in the thickness direction so as to connect the first bent portion and the second bent portion, wherein the first linear portion and the second linear portion are laid collinear.

2. The noise reducing wall system according to claim 1, wherein the stud bolt is fixed to the first board layer through welding and to the second board layer with a double nut.

* * * * *